United States Patent [19]

Solørdal

[11] Patent Number: 4,532,859

[45] Date of Patent: Aug. 6, 1985

[54] METHOD FOR IDENTIFICATION OF METAL BOXES OR CANS AND AN APPARATUS FOR CARRYING OUT SAID METHOD

[75] Inventor: Steinar Solørdal, Hvalstad, Norway

[73] Assignee: A/S Tomra Systems, Asker, Norway

[21] Appl. No.: 547,741

[22] Filed: Nov. 1, 1983

[30] Foreign Application Priority Data

Nov. 1, 1982 [NO] Norway ..... 823621

[51] Int. Cl.[3] ..... B30B 9/32

[52] U.S. Cl. ..... 100/35; 100/99; 100/902; 177/50; 194/4 C; 324/73 R

[58] Field of Search ..... 100/35, 39, 41, 99, 100/94, 98 R, 153, 902; 194/4 R, 4 C, 4 E, 4 F; 177/50, 145; 324/227, 214, 73 R; 356/357

[56] References Cited

U.S. PATENT DOCUMENTS

| | | | |
|---|---|---|---|
| Re. 27,643 | 5/1973 | Myers | 194/4 L |
| 3,691,942 | 9/1972 | Wagley | 100/902 X |
| 4,241,821 | 12/1980 | Wu et al. | 194/4 L |
| 4,248,334 | 2/1981 | Hanley | 100/902 X |
| 4,285,426 | 8/1981 | Cahill | 100/902 X |
| 4,324,325 | 4/1982 | Dewoolfson | 100/902 X |
| 4,345,679 | 8/1982 | Dewoolfson | 100/902 X |

*Primary Examiner*—Billy J. Wilhite
*Attorney, Agent, or Firm*—Kenyon & Kenyon

[57] ABSTRACT

A method and an apparatus for identification and separation of metal boxes or cans, said can (1) being placed in a motor controlled cradle (7), and said cradle with the can being rotated in a first direction (a) to a first position with a first, preferably low stepping frequency, and then being rotated or influenced for rotation (b) back in a second and opposite direction (starting point position) with a second, preferably high stepping frequency, the time of said return movement simultaneously being measured as a function of the moment of inertia caused by said can and wherein said can as a function of the measurement of time and possibly of additional measurement of the can length and metal type is thrown out (A;B) of the cradle (7) either because said cradle is rotated further in said second direction (c) or because said cradle is rotated back (d) in the first direction and past said first position. Before the can is placed in said cradle it may be scanned inductively (3) and/or capacitively (21). Also, its length can be measured optically (11,12) while it is in the cradle. When the can is thrown out in said second direction it is thrown into a can compacting device (13). The apparatus may be used e.g. in a can return deposit apparatus.

19 Claims, 7 Drawing Figures

METHOD FOR IDENTIFICATION OF METAL BOXES OR CANS AND AN APPARATUS FOR CARRYING OUT SAID METHOD

The present invention relates to a method for identification and separation of metal boxes or cans as well as an apparatus for carrying out said method. Also, the invention relates to the utilization of a metal box compacting device.

From the Swedish Patent Publication No. 420 134 a compacting device for can packing is known, where various features of the tin cans are sensed partly capacitatively and partly inductively. The measuring devices are directly connected with a guide tube in one position leading directly down to the compacting device and in a second position, determined by the measuring devices, leading directly to a collecting tray. Normally, a compacting device of the kind in question will be used for cans that were produced from one metal only, preferably aluminium. However, it happens that the can wall consists of a metal that does not contain aluminium. With a view to later remelting, it is, thus, disadvantageous that a can comprising two metals is compacted for remelting. It may, furthermore, happen that a can contains foreign matter or a liquid, e.g. remnants of a fizzy drink. If there is still left a liquid in the can, the known detector apparatus will not detect this, which may result in considerably soiling of the whole compacting device, as well as in a wet and heavy collecting means, e.g. a sack. Also, a can may contain foreign matter, like nails, pieces of glass or the like, which will be undesirable in connection with a remelting process. Also, such foreign matter may damage the compacting device. The known compacting device is, besides, not capable of sensing whether there are anomalies present.

The known apparatus, also, comprises a compacting device of the kind comprising a piston. It requires a compressor as well as a pressure tank and a number of magnet valves for operation. This contributes to make the compacting device unnecessarily expensive and complicated.

It is, thus, an object of the present invention to avoid the disadvantages of the known compacting device. The features characterizing the present invention will appear from the following claims as well as from the description with reference to the attached drawings.

Figure 1:
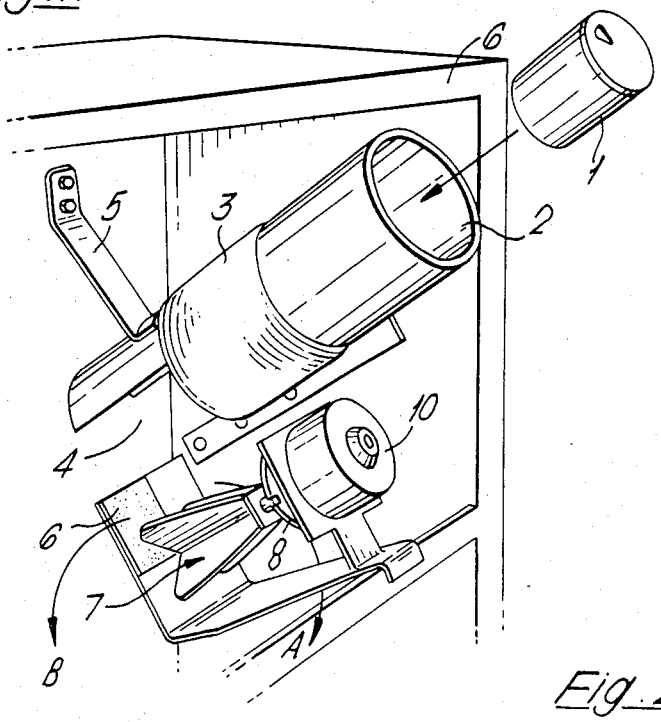
Figure 2:
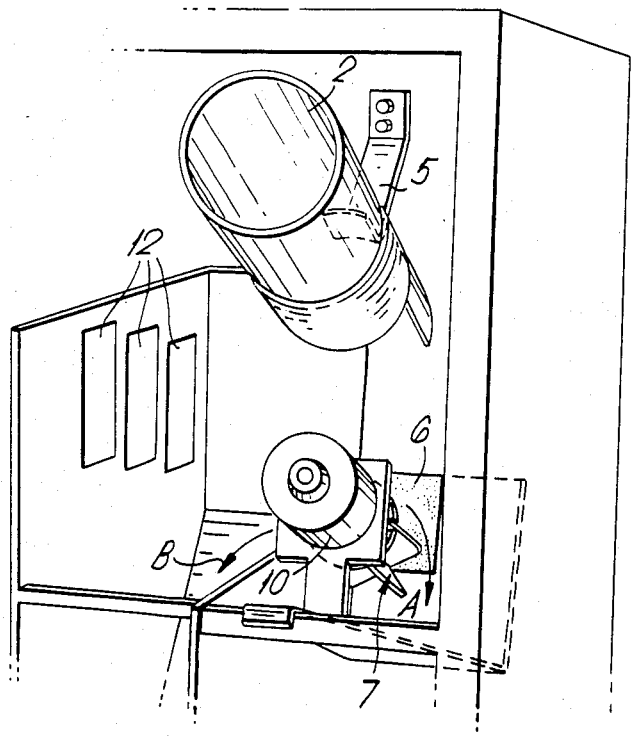
Figure 3:
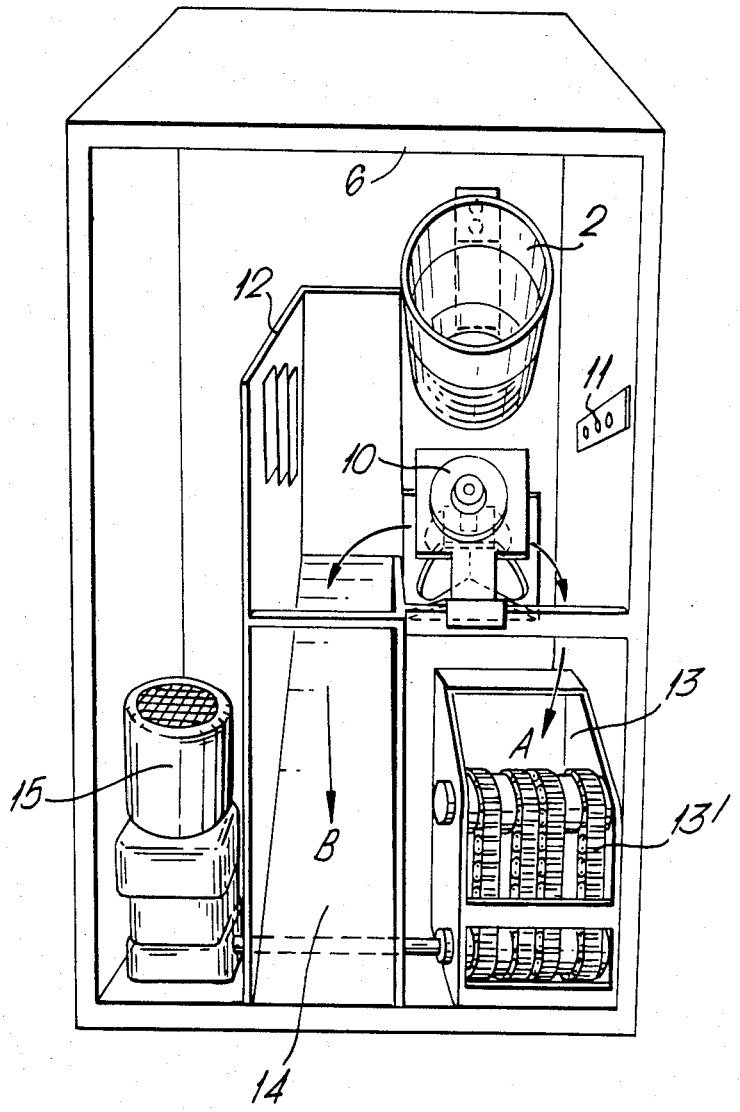

FIGS. 1, 2, and 3 illustrate a preferred embodiment of the apparatus according to the invention, as seen from different angles.

Figure 4:
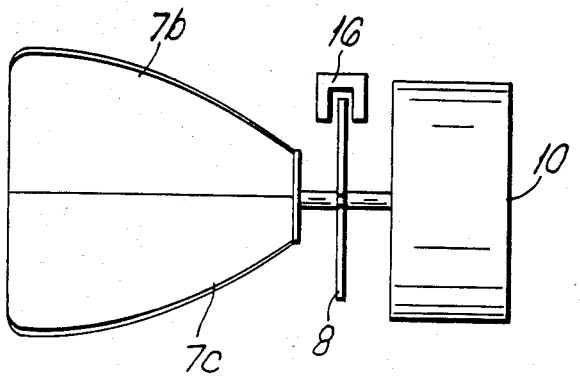
Figure 5:
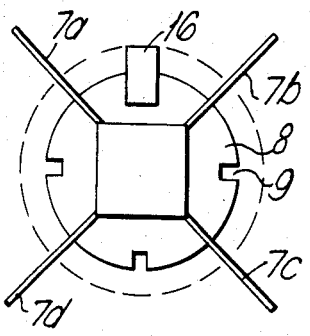

FIGS. 4 and 5 show one of the measuring devices of the apparatus according to the invention in more detail.

Figure 6:
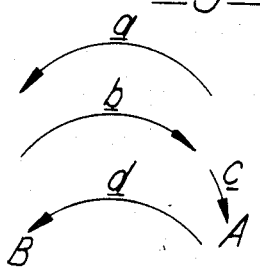

FIG. 6 clarifies the movement of the device as shown in FIGS. 4 and 5.

Figure 7:
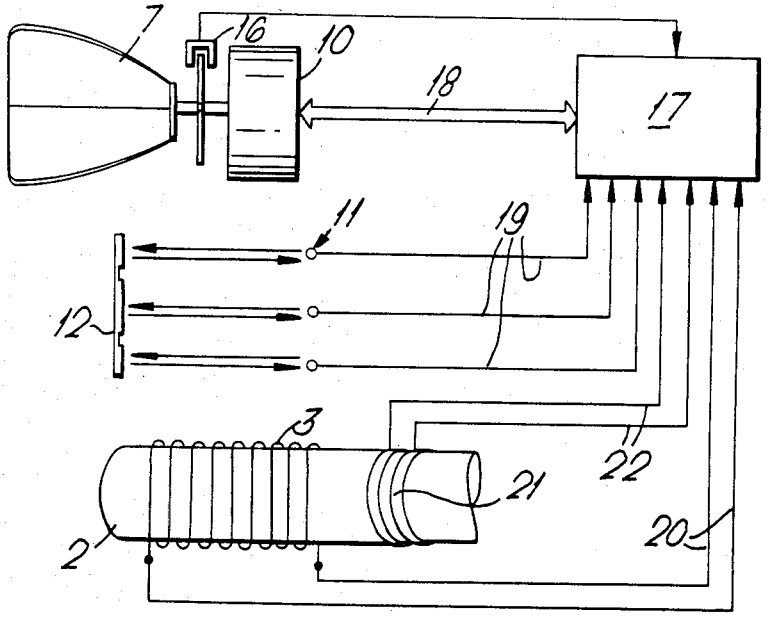

FIG. 7 is a simplified diagrammatical view of the co-operating measuring devices included in the apparatus.

A can packing 1, preferably made from aluminium, is fed into an inlet tube 2 and will pass through a metal detector, e.g. a coil 3, at the outlet 4 of said tube. Said inlet tube 2 may be attached to a cabinet 6 by mounting bracket 5.

When the can arrives at the outlet opening 4, it will impinge against a shock absorbing plate 6 and go into a cradle 7. As shown in FIG. 1, said cradle 7 is preferably slightly tilted and preferably, but not necessarily, has its axis extending in parallel with the axis of inlet tube 2.

Said cradle 7 in a preferred embodiment comprises four fins *7a*, *7b*, *7c*, and *7d* having a preferred mutual angle of 90°. The cradle 7 is connected with a stepper motor 10, if desired via a reducing coupling (not shown). On the shaft between cradle 7 and motor 10 a position disk 8 is firmly secured and provided with recording grooves 9 meant for cooperation with a position detector 16 (FIGS. 4 and 5) scanning the circumference of the disk 8 (homing).

When a can arrives in cradle 7 its length will be measured by light detectors 11, which emit and receive light via reflectors 12, said light detectors and reflectors being arranged on opposite sides of the cradle, as clearly shown in FIG. 3. The can has now been scanned both as to its principle metal and its length. As mentioned above, however, a can may have a wall of a metal other than aluminium, and/or a can may contain foreign matter, such as nails, liquid, pieces of glass, or some other kind of waste. This will result in a weight of the can that differs from the weight to be expected from its detected length and type of metal. It is, thus, essential that the weight of the can is measured to prevent cans that are not to be remelted from being compacted and mixed with cans of the acceptable kind. To this end, said cradle 7 in cooperation with position disk 8, grooves 9, and position detector 16 serves to record the weight of a can as a function of the moment of inertia, caused by the can when cradle 7 is moved. As indicated in FIG. 6, cradle 7 is at first moved in one direction a through an angle of approximately 30°. Said movement is given a very low stepping frequency and a high motor current. Then the stepper motor tries to move can 1 back into its original position, i.e. through 30° in direction b with a high velocity and a low motor current. In case of a can made entirely from aluminium and having no anomalities, groove 9 extending between the same cradle fins between which the can is placed will reach the position detector 16 within a fixed time interval associated with the moment of inertia to be expected from an acceptable can. In case of such an acceptable can stepper motor 10 will be caused to make another movement c from the starting position, as shown in FIG. 1, through an angle of 90° causing the can to be thrown out in the direction A and to land in the compacting device 13, which may be of the kind comprising chains 13', where the can is squeezed and perforated by the action of the chains.

If the can contains liquid of other matter that makes it heavier than would normally be expected, or if the can is not made from 100% of aluminium, such an anomalous can will necessarily have a greater moment of inertia than a can lacking such anomalities. When stepper motor 10, thus, tries to rotate the cradle, in the present case *7a*, *7b*, back (direction b) to the starting position, the moment of inertia of the can will be so great that the groove 9 does not reach the position detector 16 within the predetermined time interval. In this case, the stepper motor 10 with its low motor current and large stepper frequency has not managed to move the can back into its starting position within said time interval, and said stepper motor is, thus, controlled to turn back in the direction d (the same as direction a) through an angle that is at least 60°, but less than 90°. The non-acceptable can is, thus, thrown out in an orbit 14 in direction B.

If a can is e.g. almost full with a liquid or for some reason is an unopened, full can, said can when turned through 30° in direction a will already have so great a moment of inertia that it overcomes the holding force of stepper on cradle 7, and said cradle will directly go on turning to the next step in direction a and, thus, the can will be thrown out in direction B. In the shown embodiment the cradle to receive the next can will be defined by fins 7*a* and 7*b*.

In the present apparatus there are preferably used three measuring means for obtaining a unambiguous determination of acceptability or non-acceptability of the can. As shown in FIG. 7, the metal detector coil 3 is connected with circuits 20 that lead to a signal processing and control unit 17. Furthermore, a capacity metal detector 21 may be provided and connected to unit 17 by circuits 22. Utilization of either an inductive 3 or a capacitive 21 detector is feasible, and it is also possible to use both of them. In a corresponding manner photo detector 11, 12 is connected with unit 17 by circuits 19. The stepper motor 10 is connected with unit 17 via a transmission path 18, enabling unit 17 to record an excessive load on motor 10 as well as to control motor 10 for movement with a low stepping frequency and high motor current or with high stepping frequency and a low current, as disclosed in connection with FIG. 6. Position detector 16 is likewise connected with unit 17. This unit 17 can be any suitable micro computer or the like.

The compacting device 13 may be driven by a simple electric motor 15, if desired via a reduction coupling.

The present invention may especially be used in connection with a can return deposit apparatus, but it may, naturally also be used generally for identification, separation and compacting of metal boxes or cans of any kind, not necessarily cans of aluminium. Even though inlet tube 2 and cradle 7 are shown in tilted positions, these members can of course have another mutual position.

I claim:

1. A method for identification and separation of metal boxes or cans comprising:
   - placing said can in a motor-controlled cradle;
   - rotating said cradle in a first direction from a starting position to a first position with a first stepping frequency;
   - rotating said cradle in a second and opposite direction into a second position with a second stepping frequency;
   - measuring the time required to return said cradle from said first position to said second position; and
   - discharging said can as a function of said time measurement either by further rotation of said cradle in said second direction or by rotating said cradle back in said first direction and past said first position.

2. A method in accordance with claim 1, wherein said second position is said starting position.

3. A method in accordance with claim 1, wherein said second stepping frequency is greater than said first stepping frequency.

4. A method in accordance with claim 1 which further comprises scanning said can, prior to placing said can in said cradle, to determine can metal type and further using said determination in selecting where to discharge said can.

5. A method in accordance with claim 4 wherein said can is scanned inductively.

6. A method in accordance with claim 4 wherein said can is scanned capacitively.

7. A method in accordance with claim 4 wherein said can is scanned inductively and capacitively.

8. A method in accordance with claims 1 or 4 which further comprises measuring at least one dimension of said can while said can is in said cradle and further using said measurement in selecting where to discharge said can.

9. A method in accordance with claim 1 or 4 which further comprises crushing said can discharged in said second direction.

10. A method in accordance with claim 9 which further comprises measuring at least one dimension of said can while said can is in said cradle.

11. An apparatus for identification and separation of metal boxes or cans comprising:
   - a stepper motor;
   - a rotatable cradle attached to said motor, said cradle being capable of receiving said box or can;
   - means for obtaining a measure of the moment of inertia caused by said can in said cradle when said stepper motor acts to rotate said cradle from a frist position to a second position by means of a time measurement; and
   - a signal processing and control unit for further activating said motor as a function of said time measurement to throw said can out of said cradle either by rotating said cradle past said second position or by rotating said cradle back and past said first position.

12. An apparatus in accordance with claim 11, further comprising:
   - a can inlet tube positioned adjacent to said cradle for conducting said can into said cradle; and
   - a metal detector for detecting can metal type, provided on said tube, said detector communicating with said signal processing and control unit.

13. An apparatus in accordance with claim 12, wherein said detector is of the capacitive type.

14. An apparatus in accordance with claim 12, wherein said detector is of the inductive type.

15. An apparatus in accordance with claims 11 or 12 further comprising means for measuring at least one dimension of said can communicating with said signal processing and control unit.

16. An apparatus in accordance with claim 15 wherein said measuring means comprises:
   - a light detector for emitting and receiving light, said detector positioned parallel to said can in said cradle; and
   - a reflector positioned on the opposite side of said can in said cradle from said detector such that any light not impinging on said can is reflected back to and detected by said detector.

17. An apparatus in accordance with claims 11 and 12 further comprising means for compacting said can discharged by rotating said cradle past said second position.

18. An apparatus in accordance with 11 or 12 wherein said cradle is comprised of:
   - a plurality of fins projecting out from and perpendicular to said cradle.

19. An apparatus in accordance with claim 18 wherein there are four said fins distributed at 90° intervals around said cradle.

* * * * *

UNITED STATES PATENT AND TRADEMARK OFFICE

CERTIFICATE OF CORRECTION

PATENT NO. : 4,532,859

DATED : August 6, 1985

INVENTOR(S) : Steinar Solnordal

It is certified that error appears in the above-identified patent and that said Letters Patent is hereby corrected as shown below:

On the title page, Inventor's name, both occurrence, "Solørdal" should read -- Solnørdal --.

Signed and Sealed this

*Twelfth* Day of *November 1985*

[SEAL]

*Attest:*

*Attesting Officer*

DONALD J. QUIGG

*Commissioner of Patents and Trademarks*